US006053286A

United States Patent [19]

Balmer

[11] Patent Number: 6,053,286

[45] Date of Patent: Apr. 25, 2000

[54] INCLINE LIFT SYSTEM

[75] Inventor: Charles David Balmer, Ontario, Canada

[73] Assignee: Concord Elevator Inc., Brampton, Canada

[21] Appl. No.: 09/056,064

[22] Filed: Apr. 6, 1998

[51] Int. Cl.[7] ..... B66B 9/08

[52] U.S. Cl. ..... 187/201; 187/245

[58] Field of Search ..... 187/201, 239, 187/245, 246; 104/128; 105/30

[56] References Cited

U.S. PATENT DOCUMENTS 5,572,930 11/1996 Hein ..... 187/250

5,908,078 6/1999 Johansson ..... 187/201

*Primary Examiner*—Kenneth W. Noland

*Attorney, Agent, or Firm*—Thomas I. Rozsa; Tony D. Chen; Jerry Fong

[57] ABSTRACT

An incline lift system for incline operation. The lift system includes a pair of guide rails that run parallel to each other at a constant vertical gauge, on which a pair of traction roller sets move thereto. The pair of traction roller sets are mounted to a carriage frame which travels on the pair of guide rails. Each traction roller set includes a driven roller which is positioned on top of the respective guide rail and a pair of pressure rollers which are positioned below the respective guide rail. The periphery of the pressure rollers are driven into the guide rail by means of a restrained compression spring in such a way as to augment the natural gravity contact such that the primary motive force is transferred via traction. The traction roller sets are arranged in such a manner that the pressure rollers press against the respective guide rail and into the driven roller with sufficient force as to increase the gravity traction and create an adequate traction contact area to support the carriage frame.

50 Claims, 3 Drawing Sheets

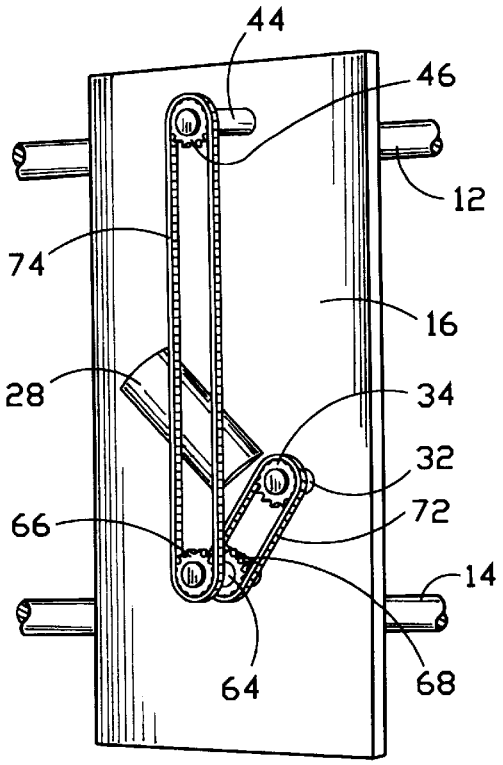
FIG.4
FIG.2
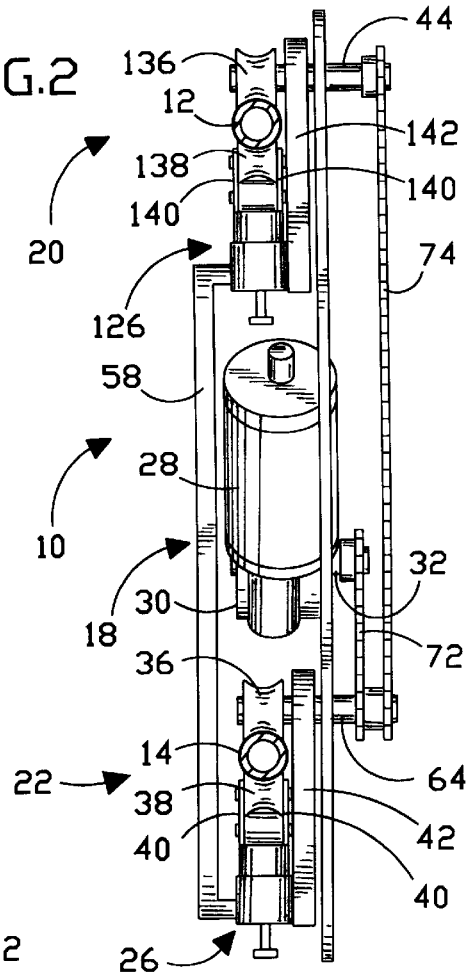
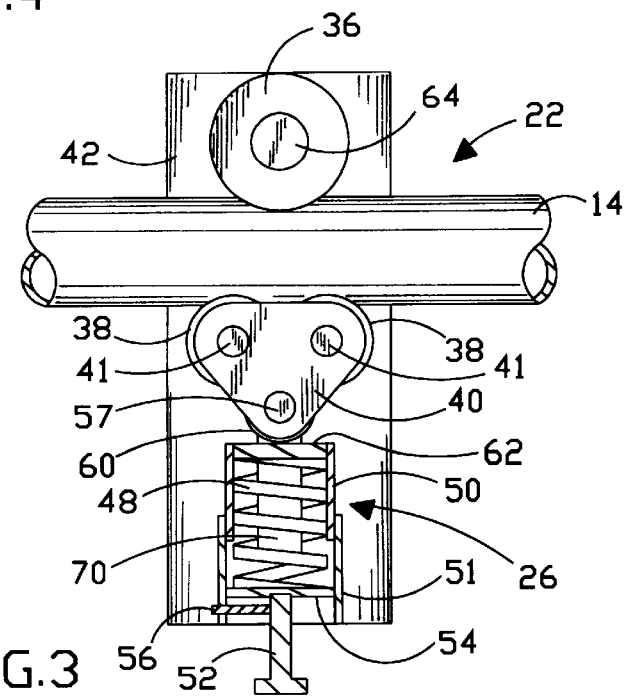
FIG.3

INCLINE LIFT SYSTEM

BACKGROUND OF THE INVENTION

1. Field of the Invention

The present invention generally relates to the field of lifts. More particularly, the present invention relates to lift systems for incline lift applications, such as incline platform lifts, in which a frame or chassis member is supported by guide rollers and movable along a track having a pair of parallel tubular guide rails.

2. Description of the Prior Art

Specifically, one known type of an incline lift system is disclosed in U.S. Pat. No. 5,572,930 issued to Hein on Nov. 12, 1996 for "Elevator System", which discloses a lift for incline or vertical operation. The elevator system comprises a pair of rollers which are rotated about the guide rail to produce the friction force. One of the many disadvantage with the prior art system is that all friction is generated by a single compression spring, which if damaged or removed would result in a partial or complete loss of friction. Another disadvantage with the prior art system is that increase load on the traveling unit has a negative effect on friction requiring static friction force to compensate for the load. A further disadvantage of the prior art system is that a third support rail is required for added stability as the travel path approaches and/or achieves horizontal. In addition, overmoulding of the rollers with polyurethane has been done in such a manner that the rollers squeak during travel and wear out very quickly at the outer edges. A still further disadvantage of the prior art incline lift system is that the use of swivel plates to rotatably drive the rollers into the guide rail which causes the main support axis of the carriage to be offset from the drive axis in such a way that the structural support of the carriage and load is flexible as the swivel plates rotate (i.e: not a positive mechanical connection).

It is highly desirable to have a very efficient and also very effective design and construction of an incline lift system which eliminates all of the disadvantages mentioned above. It is desirable to provide an incline lift system which allows horizontal and vertical bends as well as being able to ascend and descend at an angle in the same direction of travel. It is also desirable to provide an incline lift system that eliminates the possibility of binding between guide rails as a result of being driven on only the top or bottom guide rail.

SUMMARY OF THE INVENTION

The present invention is an incline lift system for incline operation. The lift system comprises a pair of guide rails that run parallel to each other at a constant vertical gauge, on which a pair of traction roller sets move thereto. The pair of traction roller sets are mounted to a carriage frame which travels on the pair of guide rails. Each traction roller set includes a driven roller which is positioned on top of the respective guide rail and a pair of pressure rollers which are positioned below the respective guide rail. The periphery of the pressure rollers are driven into the guide rail by means of a restrained compression spring in such a way as to augment the natural gravity contact such that the primary motive force is transferred via traction. The traction roller sets are arranged in such a manner that the pressure rollers press against the respective guide rail and into the driven roller with sufficient force as to increase the gravity traction and create an adequate traction contact area to support the carriage frame.

It is an object of the present invention to provide an incline lift system which comprises a pair of opposite traction roller sets which operate in tandem to ensure smooth operation and eliminate the possibility of binding between tubes as a result of being driven on only the top or bottom guide rail.

It is also an object of the present invention to provide an incline lift system which allows horizontal and vertical bonds (including spirals) as well as being able to ascend and descend at an angle in the same direction of travel.

It is an additional object of the present invention to provide an incline lift system which has means for providing a self leveling effect as a result of the uniform vertical distance between the guide rails.

It is a further object of the present invention to provide an incline lift system which has means for retaining a broken compression spring and still capable of supplying pressure thereto.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 2 is an enlarged partial cross-sectional view taken along line 2—2 of FIG. 1;

FIG. 3 is an enlarged front elevational view of a lower one of a pair of traction roller sets of the present invention incline lift system;

FIG. 4 is a back perspective view of the present invention incline lift system, showing a motor drive assembly;

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
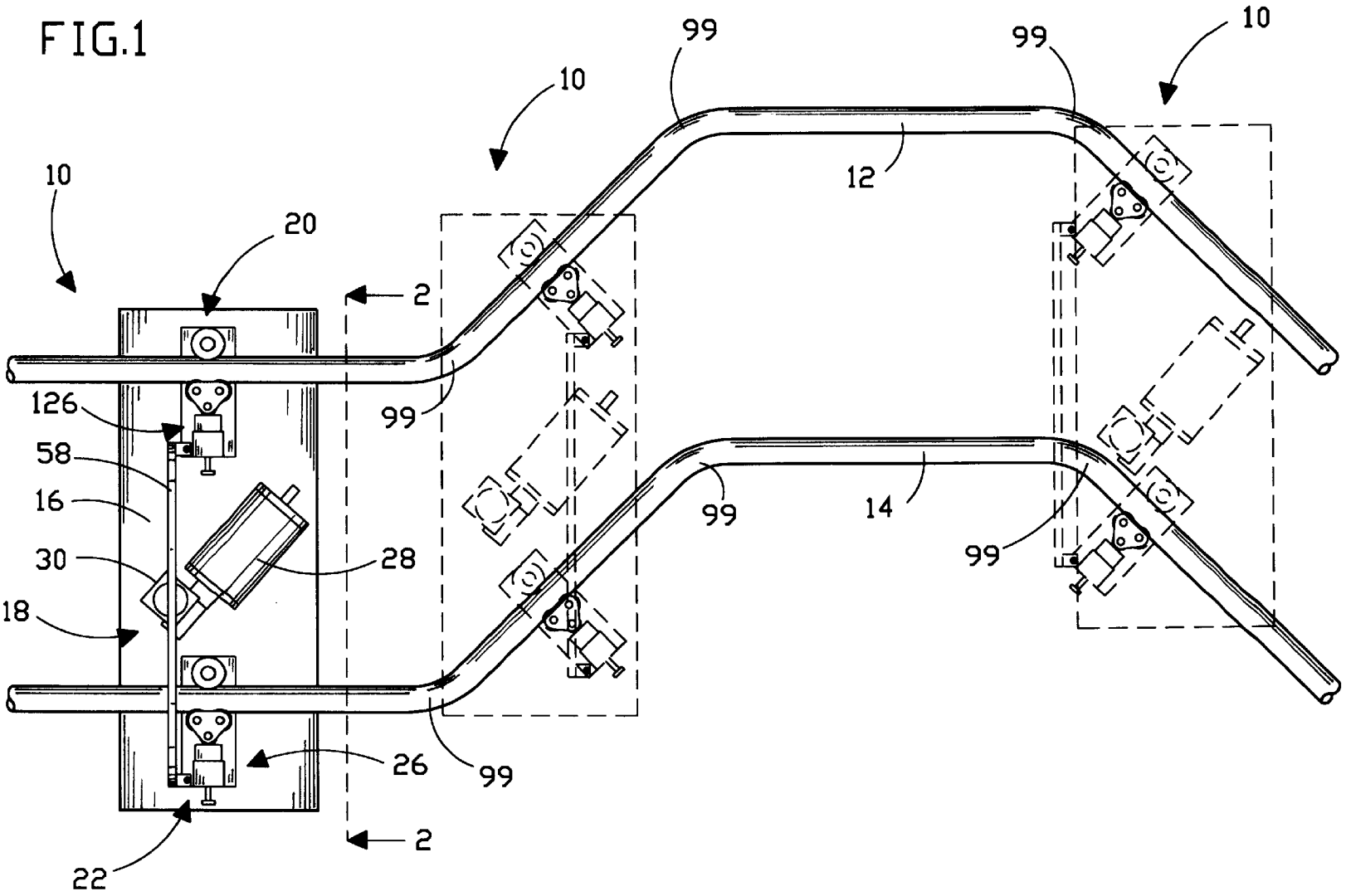
FIG. 1 is a schematic view of a preferred embodiment of the present invention incline lift system, showing the incline lift system in various positions along the track.

Referring to FIG. 1, there is shown at 10 a preferred embodiment of the present invention incline lift system positioned on a track which includes a pair of elongated tubular guide rails 12 and 14. There are dashed lines to show various positions of the incline lift system 10 along the track. The pair of elongated tubular guide rails 12 and 14 may be arranged along a stairway step nose angle (not shown) and mounted to a vertical support (not shown). The guide rails 10 and 12 are parallel to each other and have a constant vertical gauge.

Referring to FIGS. 1, 2 and 4, the incline lift system 10 comprises a carriage frame 16, on which is provided a motor drive assembly 18 that includes an electrical motor 28 and a gear box 30. The motor 28 is mounted on and secured to the carriage frame 16 and centrally located. A driving shaft 32 is coupled to the gear box 30 which is driven by the motor 28. The driving shaft 32 extends through the carriage frame 16 on the other side, wherein a driving sprocket wheel 34 is rotatably mounted on the free end of the driving shaft 32.

Referring to FIGS. 1, 2, 3, and 4, the incline lift system 10 is provided with an upper traction roller set 20 and a lower traction roller set 22. For ease of understanding, only the lower traction roller set 22 will be described in detail since it should be understood that the upper traction roller set 20 is identical and identical parts are numbered correspondingly with 100 added to each number. The only difference between the upper and lower traction roller sets 20 and 22 is rotatable shafts 44 and 64, respectively. The rotatable shaft 64 comprises a pair of spaced apart sprocket wheels 66 and 68 while the rotatable shaft 44 has only one sprocket wheel 46 which is aligned with the outer sprocket wheel 66.

The traction roller set 22 includes an upper fixed driven roller 36 and a pair of spaced apart lower pressure rollers 38 for engaging opposite sides of the guide rail 14. The lower rollers 38 are sandwiched between a pair of triangular shaped brackets 40 and rotatably supported on axles 41. The lower rollers 38 are arranged on dual rotation axes in both horizontal and vertical planes to provide omni-directional movement of the pressure rollers 38. The driven roller 36 is rotatably mounted on the rotatable shaft 64 which extends through a mounting plate 42 and the carriage frame 16 to the other side thereof, where the pair of sprocket wheels 66 and 68 are rotatably mounted to the free end of the shaft 64. The traction roller set 22 further includes a pressing mechanism 26 which includes a pressing roller 60 rotatably mounted between the brackets 40 by an axle 57, and a restrained compression spring 48 which is housed in a pair of interlocking tubes 50 and 51. The lower interlocking tube 51 is fixed to the mounting plate 42 by conventional means such as bolts or welding means, where the upper interlocking tube 50 is moveable therein in an up and down direction as well as rotational movement. The X-axis and Y-axis movements are accomplished by the pressure rollers 38 for slight rotation (minor adjustment), where the axle 57 rotates in the X-axis and Y-axis. The Z-axis movement is accomplished by the pressure rollers 38, brackets 40 and lower interlocking tube 50 relative to the upper interlocking tube 51. For drastic changes such positions 99, the axle 44 is utilized for the changes where the driven roller 36 rotates around on the axle 44.

A stabilizing shaft 70 is attached to the pressing roller 60 and extends downwardly through the top plate 62 of the upper interlocking tube 50 and into the housing where the compression spring 48 is located. The stabilizing shaft 70 stabilizes the compression spring 48 within the interlocking tubes 50 and 51. The upper interlocking tube 50 and the pair of triangular shaped brackets 40 rotate about the center of the spring 48 as well as providing an additional hinge point below the pressure rollers 38 of the traction roller set 22. This provides rotation in both axes, allowing the pressure rollers 38 to self-align with the guide rail 14, while still ensuring proper positioning of the upper fixed driven roller 36.

Referring to FIG. 3, the pressing mechanism 26 further includes a traction adjustment bolt 52 which is affixed to an internal plate 54 and slidably located within the lower interlocking tube 51 for allowing the internal plate 54 to be adjusted upwards and subsequently compressing the spring 48, and providing additional traction pressure. The adjustment bolt 52 is fitted with a set screw 56 to provide a positive lock once traction has been properly adjusted. The interlocking tubes 50 and 51 used to restrain the compression spring 48 ensure that in the event of a broken spring, the pieces are properly retained and still capable of supplying pressure thereto.

Referring to FIGS. 1 and 4, there is shown a first drive chain 72 which engages the driving sprocket wheel 34 and the inner sprocket wheel 68. A second drive chain 74 engages the sprocket wheel 46 of the upper traction roller set 20 and the outer sprocket wheel 66 of the lower traction roller set 22. The motor 28 actuates the gearbox 30 which in turn rotates the driving shaft 32, which in turn rotates the sprocket wheel 34 which in turn moves the drive chain 72 to rotate the inner sprocket wheel 68 of the lower traction roller set 22, which in turn rotates the outer sprocket wheel 66 which moves the chain 74 to rotate the sprocket wheel 46 of the upper traction roller set 20 to move the carriage frame 16 along the first and second rails 12 and 14 in either direction, wherein the upper roller set 20 contacts the first guide rail 12 only by traction.

The pressing mechanisms 26 and 126 generate sufficient traction between the roller sets 20 and 22 and the upper and lower guide rails 12 and 14, respectively, in response to actuation of the drive assembly 18, where the carriage frame 16 moves along the upper and lower guide rails 12 and 14 in either direction as the pressure rollers 38 and 138 of the roller sets 20 and 22 rotate, due to the rotation of the fixed driven rollers 36 and 136 of the roller sets 20 and 22 respectively.

The pressing mechanisms 26 and 126 create sufficient traction contact area between the rollers of the upper and lower roller sets 20 and 22 and the respective guide rails to support the weight of the carriage frame 16, where each compression spring directly engages the pressure rollers of the upper and lower roller sets at a direction exactly perpendicular to the upper and lower guide rails respectively.

Referring to FIG. 1, the incline lift system 10 further includes a mechanical tie bar 58 which provides positive connection between the mounting plates 42 and 142. This would ensure that both the mounting plates 42 and 142 would rotate simultaneously when encountering any change in travel angle subsequently providing additional stability when traversing the guide rails 12 and 14. If necessary these would be used to eliminate the potential for the travel unit to walk along the rail as a result of inconsistent driven roller rotation.

Figure 5:
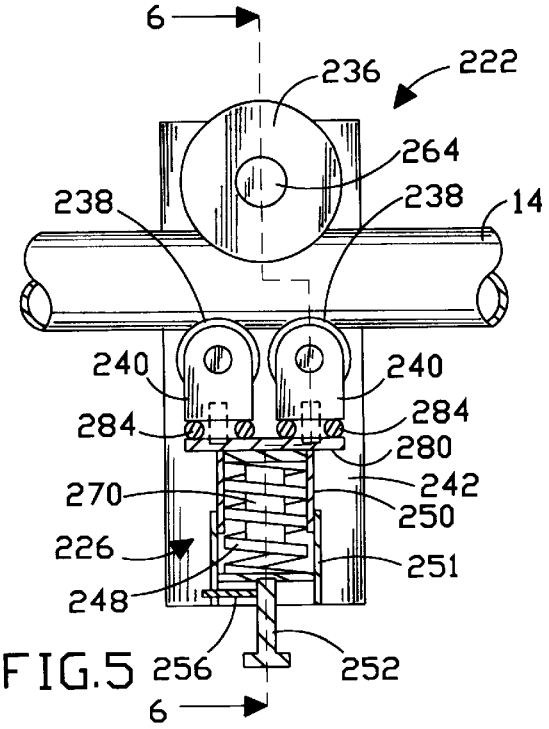
FIG. 5 is an enlarged front elevational view of an alternative embodiment of the lower traction roller set which corresponds with the lower traction roller set shown in FIG. 3.
Figure 6:
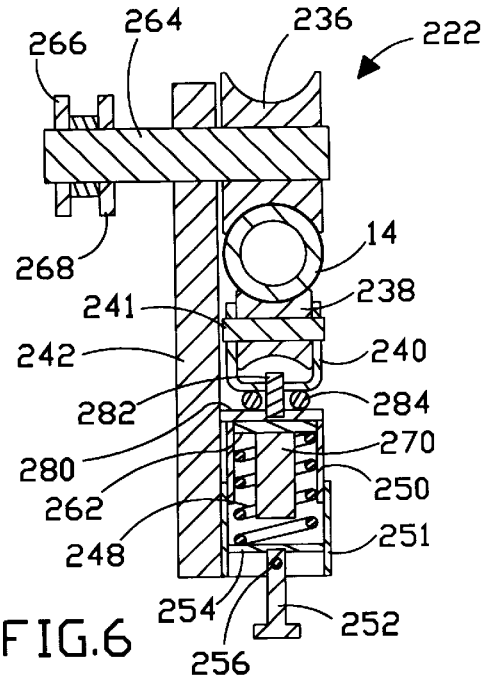
FIG. 6 is an enlarged cross-sectional view taken along line 6—6 of FIG. 5.

Referring to FIGS. 5 and 6, there is shown an alternative embodiment of the lower traction set 222 which is very similar to the lower traction set 22 just discussed. All of the parts of the alternative embodiment of the lower traction set 222 are numbered correspondingly with 200 added to each number.

The present invention incline lift system utilizes an upper traction roller set (not shown) and the lower traction roller set 222. For ease of understanding, only the lower traction roller set 222 will be described in detail since it should be understood that the upper traction roller set is identical. The only difference between the upper and lower traction roller sets is rotatable shafts 264 (see FIG. 6). The rotatable shaft 264 comprises a pair of spaced apart sprocket wheels 266 and 268 while the rotatable shaft on the upper traction roller has only one sprocket wheel which is aligned with the outer sprocket wheel 266 (similar to the upper traction roller set 20 of FIGS. 2 and 4).

The traction roller set 222 includes an upper fixed driven roller 236 and a pair of spaced apart lower pressure rollers 238 for engaging opposite sides of the guide rail 14. Each pressure roller 238 is coupled to a yoke 240 by an axle 241. The driven roller 236 is rotatably mounted on the rotatable shaft 264 which extends through a mounting plate 242 and the carriage frame (not shown) to the other side thereof, where the pair of sprocket wheels 266 and 268 are rotatably mounted to the free end of the shaft 264. The traction roller set 222 further includes a pressing mechanism 226 which includes a restrained compression spring 248 housed in a pair of interlocking tubes 250 and 251, and a support plate 280 fixed to the upper end of the upper interlocking tube 250 and contacts the mounting plate 242. The lower interlocking tube 251 is fixed to the mounting plate 242 by conventional means such as bolts or welding means, where the upper interlocking tube 250 is moveable therein in an up and down direction. The support plate 280 has a pair of spaced apart radial axles 282 extending upwardly to respectively receive and secure the yokes 240. A pair of bearings 284 are respectively installed between each yoke 240 and the support plate 280 to permit horizontal plane rotation. The pressure rollers 238 with the radial axles 282 permit rotation in the horizontal plane, thereby providing the pressure rollers 238 with omni-directional movement while allowing the yokes 240 to remain fixed with respect to the driven roller 236 in the vertical plane. The interlocking tube 250 does not have movement on the Z-axis do to the fact that the support plate 280 is in contact with the mounting plate 242, while the pressure rollers 238 have movement on the Z-axis around the radial axles 282. In addition, the pressure rollers 238 and the yokes 240 move around axles 282 for movement on the Z-axis. For drastic changes such positions 99 (see FIG. 1), the axle 264 of the lower traction roller set 222 is utilized for the changes where the driven roller 236 rotates around on the axle 264.

A stabilizing shaft 270 is attached to the underside of the upper plate of the interlocking tube 250 and extends downwardly into the housing where the compression spring 248 is located. The stabilizing shaft 270 stabilizes the compression spring 248 within the interlocking tubes 250 and 251.

The pressing mechanism 226 further includes a traction adjustment bolt 252 which is affixed to an internal plate 254 and slidably located within the lower interlocking tube 251 for allowing the internal plate 254 to be adjusted upwards and subsequently compressing the spring 248, and providing additional traction pressure. The adjustment bolt 252 is fitted with a set screw 256 to provide a positive lock once traction has been properly adjusted. The interlocking tubes 250 and 251 used to restrain the compression spring 248 ensure that in the event of a broken spring, the pieces are properly retained and still capable of supplying pressure thereto.

Figure 7:
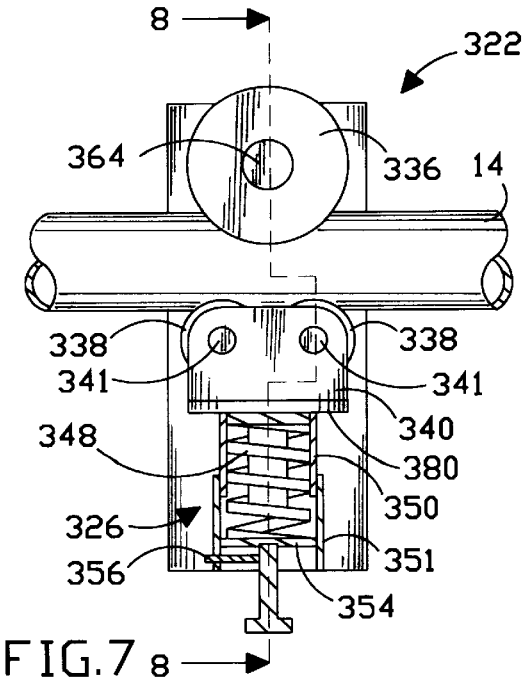
FIG. 7 is an enlarged front elevational view of another alternative embodiment of the lower traction roller set which corresponds with the lower traction roller set shown in FIG. 3.
Figure 8:
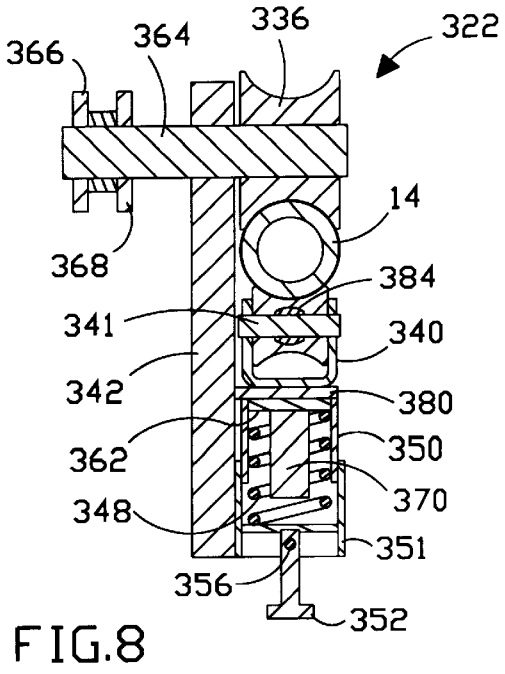
FIG. 8 is an enlarged cross-sectional view taken along line 8—8 of FIG. 7.

Referring to FIGS. 7 and 8, there is shown another alternative embodiment of the lower traction set 322 which is very similar to the lower traction set 22 discussed above. All of the parts of this embodiment of the lower traction set 322 are numbered correspondingly with 300 added to each number.

The present invention incline lift system utilizes an upper traction roller set (not shown) and the lower traction roller set 322. For ease of understanding, only the lower traction roller set 322 will be described in detail since it should be understood that the upper traction roller set is identical. The only difference between the upper and lower traction roller sets is rotatable shafts 364 (see FIG. 8). The rotatable shaft 364 comprises a pair of spaced apart sprocket wheels 366 and 368 while the rotatable shaft on the upper traction roller has only one sprocket wheel which is aligned with the outer sprocket wheel 366 (similar to the upper traction roller set 20 of FIGS. 2 and 4).

The traction roller set 322 includes an upper fixed driven roller 336 and a pair of spaced apart lower pressure rollers 338 for engaging opposite sides of the guide rail 14. The pressure roller 338 are coupled to a yoke 340 by a pair of axles 341. The driven roller 336 is rotatably mounted on the rotatable shaft 364 which extends through a mounting plate 342 and the carriage frame (not shown) to the other side thereof, where the pair of sprocket wheels 366 and 368 are rotatably mounted to the free end of the shaft 364. The traction roller set 322 further includes a pressing mechanism 326 which includes a restrained compression spring 348 housed in a pair of interlocking tubes 350 and 351, and a support plate 380 fixed to the upper end of the upper interlocking tube 350 and the bottom end of the yoke 340 and comes in contact with the mounting plate 342. The lower interlocking tube 351 is fixed to the mounting plate 342 by conventional means such as bolts or welding means, where the upper interlocking tube 350 is moveable therein in an up and down direction. A pair of self-aligning universal bearings 384 are respectively installed on the axles 341 to permit the horizontal plane rotation, while also ensuring that the pressure roller yoke 340 remain fixed with respect to the driven roller 336 in the vertical plane. The pressure rollers 338 have slight up and down movements. For drastic changes such positions 99 (see FIG. 1), the axle 364 on the lower traction roller set 322 is utilized for the changes where the driven roller 336 rotates around on the axle 364.

A stabilizing shaft 370 is attached to the underside of the upper plate of the interlocking tube 350 and extends downwardly into the housing where the compression spring 348 is located. The stabilizing shaft 370 stabilizes the compression spring 348 within the interlocking tubes 350 and 351.

The pressing mechanism 326 further includes a traction adjustment bolt 352 which is affixed to an internal plate 354 and slidably located within the lower interlocking tube 351 for allowing the internal plate 354 to be adjusted upwards and subsequently compressing the spring 348, and providing additional traction pressure. The adjustment bolt 352 is fitted with a set screw 356 to provide a positive lock once traction has been properly adjusted. The interlocking tubes 350 and 351 used to restrain the compression spring 348 ensure that in the event of a broken spring, the pieces are properly retained and still capable of supplying pressure thereto.

The present invention conforms to conventional forms of manufacture or any other conventional way known to one skilled in the art. By way of example, the traction roller sets can be made of steel or composite clad steel.

Defined in detail, the present invention is an incline lift system, comprising: (a) a first tubular guide rail extending parallel to a stairway step nose angle and mounted to a vertical support; (b) a carriage frame being movable along the first rail in either direction; (c) a first roller set including a fixed driven roller and a pair of pressure rollers for engaging opposite sides of the first rail; (d) a first coupling means for coupling the first roller set to the lift carriage frame; (e) a first pressing mechanism for pressing the pair of pressure rollers on a lower side of the first guide rail, which in turn presses the first guide rail against the fixed driven roller on an upper side of the first guide rail to create sufficient traction contact area between the first roller set and the first guide rail to support the weight of the carriage frame; (f) a second tubular guide rail extending along and mounted to the vertical support and parallel to the first guide rail at a constant vertical gauge; (g) a second roller set including a fixed driven roller and a pair of pressure rollers for engaging opposite sides of the second guide rail; (h) a second coupling means for coupling the second roller set to the carriage frame; (i) a second pressing mechanism for pressing the pair of pressure rollers of the second roller set on a lower side of the second guide rail, which in turn presses the second guide rail against the fixed driven roller of the second roller set on an upper side of the second guide rail to create sufficient traction contact area between the second roller set and the second guide rail, and also to support the weight of the carriage frame; (j) a drive means respectively coupled to the fixed driven rollers of the first and second roller sets for driving the fixed driven rollers in either direction; (k) the first and second pressing mechanisms generate sufficient traction between the first and second roller sets and the first and second guide rails respectively, in response to actuation of the drive means, where the carriage frame moves along the first and second guide rails in either direction as the pressure rollers of the first and second roller sets rotate, due to the rotation of the fixed driven rollers of the first and second roller sets; (l) the first and second coupling means, each including a mounting plate coupled to the carriage frame at a point coincident with the axes of the fixed driven rollers of the first and second roller sets respectively for supporting the weight of the carriage frame; and (m) each of the pressing mechanism including a compression spring that directly engages the respective roller set at a direction perpendicular to the respective guide rail.

Defined broadly, the present invention is a lift system, comprising: (a) a first guide rail extending parallel to a stairway step nose angle and mounted to a vertical support; (b) a carriage frame being movable along the first rail in either direction; (c) a first roller set including at least one driven roller and at least one pressure roller for engaging opposite sides of the first rail; (d) a first coupling means for coupling the first roller set to the lift carriage frame; (e) a first pressing means for pressing the at least one pressure roller on the first guide rail, which in turn presses the first guide rail against the at least one driven roller to create sufficient traction contact area between the first roller set and the first guide rail to support the weight of the carriage frame; (f) a second guide rail extending along and mounted to the vertical support and parallel to the first guide rail at a constant vertical gauge; (g) a second roller set including at least one driven roller and at least one pressure roller for engaging opposite sides of the second guide rail; (h) a second coupling means for coupling the second roller set to the carriage frame; (i) a second pressing means for pressing the at least one pressure roller of the second roller set on the second guide rail, which in turn presses the second guide rail against the at least one driven roller of the second roller set to create sufficient traction contact area between the second roller set and the rail, and also to support the weight of the carriage frame; (j) a drive means respectively coupled to the at least one driven roller of the first and second roller sets for driving the each at least one driven roller in either direction; (k) the first and second pressing means generate sufficient traction between the first and second roller sets and the first and second guide rails respectively, in response to actuation of the drive means, where the carriage frame moves along the first and second guide rails in either direction as the at least one pressure roller of the first and second roller sets rotate, due to the rotation of the at least one driven rollers of the first and second roller sets; (l) the first and second coupling means, each including a mounting plate coupled to the carriage frame at a point coincident with the axes of the at least one driven roller of the first and second roller sets respectively for supporting the weight of the carriage frame; and (m) each of the pressing means including a spring means that directly engages the respective roller set at a direction perpendicular to the respective guide rail.

Defined more broadly, the present invention is a lift system, comprising: (a) a first rail extending parallel to a stairway step nose angle and mounted to a vertical support; (b) a frame being movable along the first rail; (c) a first roller set for engaging opposite sides of the first rail; (d) a first coupling means for coupling the first roller set to the frame; (e) a first pressing means for pressing the first roller set against the first rail to create sufficient traction contact area between the first roller set and the first rail to support the weight of the frame; (f) a second rail extending along and mounted to the vertical support and parallel to the first rail at a constant vertical gauge; (g) a second roller set for engaging opposite sides of the second rail; (h) a second coupling means for coupling the second roller set to the frame; (i) a second pressing means for pressing the second roller set against the second rail to create sufficient traction contact area between the second roller set and the second rail, and also to support the weight of the frame; (j) a drive means respectively coupled to the first and second roller sets for driving the frame in either direction; and (k) each of the pressing means including a spring means that directly engages the respective roller set at a direction perpendicular to the respective rail.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A lift system, comprising:

a. a first rail extending parallel to a stairway step nose angle and mounted to a vertical support;

b. a frame being movable along said first rail;

c. a first roller set for engaging opposite sides of said first rail;

d. a first coupling means for coupling said first roller set to said frame;

e. a first pressing means for pressing said first roller set against said first rail to create sufficient traction contact area between said first roller set and said first rail to support the weight of said frame;

f. a second rail extending along and mounted to the vertical support and parallel to said first rail at a constant vertical gauge;

g. a second roller set for engaging opposite sides of said second rail;

h. a second coupling means for coupling said second roller set to said frame;

i. a second pressing means for pressing said second roller set against said second rail to create sufficient traction contact area between said second roller set and said second rail, and also to support the weight of said frame;

j. a drive means respectively coupled to said first and second roller sets for driving said frame in either direction; and k. each of said pressing means including a spring means that directly engages the respective roller set at a direction perpendicular to the respective rail, each of said pressing means further including a traction adjustment bolt connected to an internal plate which is slidably located within a pair of interlocking tubes for allowing the internal plate to be adjusted to compress said spring means and providing additional traction pressure.

2. The lift system in accordance with claim 1 further comprising a set screw for providing a positive lock on said traction adjustment bolt once traction has been properly adjusted.

3. The lift system in accordance with claim 1 wherein said first and second pressing means generate sufficient traction between said first and second roller sets and said first and second rails respectively, in response to actuation of said drive means, where said frame moves along said first and second rails in either direction as said first and second roller sets rotate, due to the rotation of said first and second roller sets.

4. The lift system in accordance with claim 1 wherein said first and second coupling means, each including a mounting plate coupled to said frame at a point coincident with the axes of said first and second roller sets respectively for supporting the weight of said frame.

5. The lift system in accordance with claim 4 further comprising a tie bar connecting said each mounting plate to provide positive connection between said each mounting plate and to ensure that said each mounting plate rotates simultaneously when encountering any change in travel angle subsequently providing additional stability when traversing said first and second rails.

6. The lift system in accordance with claim 1 wherein said first and second roller sets comprise an upper fixed roller and a pair of lower pressure rollers.

7. The lift system in accordance with claim 6 further comprising a bracket for respectively receiving each of said pair of pressure rollers, where the bracket is secured on a radial axle to permit rotation in the horizontal plane, thereby providing said pair of pressure rollers with omni-directional movement while allowing the bracket to remain fixed with respect to said upper fixed roller in the vertical plane.

8. The lift system in accordance with claim 7 further comprising a self-aligning bearing located within each of said pair of pressure rollers for permitting the horizontal plane rotation while ensuring that said bracket remain fixed with respect to said fixed roller in the vertical plane.

9. The lift system in accordance with claim 6 wherein said pressure rollers of said first and second roller sets are arranged on dual rotation axes in both horizontal and vertical planes to provide an omni-directional movement of said pressure rollers to maintain traction contact though complex bends in said first and second rails.

10. The lift system in accordance with claim 6 wherein said fixed driven rollers of said first and second roller sets are equipped with a polyurethane traction rib located on the center line of the roller periphery in such a manner as to increase traction while avoiding the tangential contact area to increase wear ability.

11. The lift system in accordance with claim 6 wherein said fixed driven rollers of said first and second roller sets are made of steel.

12. The lift system in accordance with claim 6 wherein said fixed driven rollers of said first and second roller sets are made of composite clad steel.

13. A lift system, comprising:

a. a first guide rail extending parallel to a stairway step nose angle and mounted to a vertical support;

b. a carriage frame being movable along said first rail in either direction;

c. a first roller set including at least one driven roller and at least one pressure roller for engaging opposite sides of said first rail;

d. a first coupling means for coupling said first roller set to said lift carriage frame;

e. a first pressing means for pressing said at least one pressure roller on said first guide rail, which in turn presses said first guide rail against said at least one driven roller to create sufficient traction contact area between said first roller set and said first guide rail to support the weight of said carriage frame;

f. a second guide rail extending along and mounted to the vertical support and parallel to said first guide rail at a constant vertical gauge;

g. a second roller set including at least one driven roller and at least one pressure roller for engaging opposite sides of said second guide rail;

h. a second coupling means for coupling said second roller set to said carriage frame;

i. a second pressing means for pressing said at least one pressure roller of said second roller set on said second guide rail, which in turn presses said second guide rail against said at least one driven roller of said second roller set to create sufficient traction contact area between said second roller set and said rail, and also to support the weight of said carriage frame;

j. a drive means respectively coupled to said at least one driven roller of said first and second roller sets for driving said each at least one driven roller in either direction;

k. said first and second pressing means generate sufficient traction between said first and second roller sets and said first and second guide rails respectively, in response to actuation of said drive means, where said carriage frame moves along said first and second guide rails in either direction as said at least one pressure roller of said first and second roller sets rotate, due to the rotation of said at least one driven rollers of said first and second roller sets;

l. said first and second coupling means, each including a mounting plate coupled to said carriage frame at a point coincident with the axes of said at least one driven roller of said first and second roller sets respectively for supporting the weight of said carriage frame; and m. each of said pressing means including a spring means that directly engages the respective roller set at a direction perpendicular to the respective guide rail.

14. The lift system in accordance with claim 13 wherein each of said pressing means further includes a traction adjustment bolt connected to an internal plate which is slidably located within a pair of interlocking tubes for allowing the internal plate to be adjusted to compress said spring means and providing additional traction pressure.

15. The lift system in accordance with claim 14 further comprising a set screw for providing a positive lock on said traction adjustment bolt once traction has been properly adjusted.

16. The lift system in accordance with claim 13 wherein each said at least one pressure roller of said first and second roller sets is arranged on dual rotation axes in both horizontal and vertical planes to provide an omni directional movement of each said at least one pressure roller to maintain traction contact though complex bends in said first and second guide rails.

17. The lift system in accordance with claim 13 wherein each said at least one driven roller of said first and second roller sets is equipped with a polyurethane traction rib located on the center line of the roller periphery in such a manner as to increase traction while avoiding the tangential contact area to increase wear ability.

18. The lift system in accordance with claim 13 wherein each said at least one driven roller of said first and second roller sets is made of steel.

19. The lift system in accordance with claim 13 wherein each said at least one driven roller of said first and second roller sets is made of composite clad steel.

20. An incline lift system, comprising:

a. a first tubular guide rail extending parallel to a stairway step nose angle and mounted to a vertical support;

b. a carriage frame being movable along said first rail in either direction;

c. a first roller set including a fixed driven roller and a pair of pressure rollers for engaging opposite sides of said first rail;

d. a first coupling means for coupling said first roller set to said lift carriage frame;

e. a first pressing mechanism for pressing said pair of pressure rollers on a lower side of said first guide rail, which in turn presses said first guide rail against said fixed driven roller on an upper side of said first guide rail to create sufficient traction contact area between said first roller set and said first guide rail to support the weight of said carriage frame;

f. a second tubular guide rail extending along and mounted to the vertical support and parallel to said first guide rail at a constant vertical gauge;

g. a second roller set including a fixed driven roller and a pair of pressure rollers for engaging opposite sides of said second guide rail;

h. a second coupling means for coupling said second roller set to said carriage frame;

i. a second pressing mechanism for pressing said pair of pressure rollers of said second roller set on a lower side of said second guide rail, which in turn presses said second guide rail against said fixed driven roller of said second roller set on an upper side of said second guide rail to create sufficient traction contact area between said second roller set and said second guide rail, and also to support the weight of said carriage frame;

j. a drive means respectively coupled to said fixed driven rollers of said first and second roller sets for driving said fixed driven rollers in either direction;

k. said first and second pressing mechanisms generate sufficient traction between said first and second roller sets and said first and second guide rails respectively, in response to actuation of said drive means, where said carriage frame moves along said first and second guide rails in either direction as said pressure rollers of said first and second roller sets rotate, due to the rotation of said fixed driven rollers of said first and second roller sets;

l. said first and second coupling means, each including a mounting plate coupled to said carriage frame at a point coincident with the axes of said fixed driven rollers of said first and second roller sets respectively for supporting the weight of said carriage frame; and m. each of said pressing mechanisms including a compression spring that directly engages the respective roller set at a direction perpendicular to the respective guide rail.

21. The incline lift system in accordance with claim 20 wherein each of said pressing mechanisms further includes a traction adjustment bolt connected to an internal plate which is slidably located within a pair of interlocking tubes for allowing the internal plate to be adjusted to compress said spring means and providing additional traction pressure.

22. The incline lift system in accordance with claim 21 further comprising a set screw for providing a positive lock on said traction adjustment bolt once traction has been properly adjusted.

23. The incline lift system in accordance with claim 20 wherein said pressure rollers of said first and second roller sets are arranged on dual rotation axes in both horizontal and vertical planes to provide an omni directional movement of said pressure rollers to maintain traction contact though complex bends in said first and second guide rails.

24. The incline lift system in accordance with claim 20 wherein said fixed driven rollers of said first and second roller sets are equipped with a polyurethane traction rib located on the center line of the roller periphery in such a manner as to increase traction while avoiding the tangential contact area to increase wear ability.

25. The incline lift system in accordance with claim 20 wherein said fixed driven rollers of said first and second roller sets are made of steel.

26. The incline lift system in accordance with claim 20 wherein said fixed driven rollers of said first and second roller sets are made of composite clad steel.

27. A lift system, comprising:

a. a first rail extending parallel to a stairway step nose angle and mounted to a vertical support;

b. a frame being movable along said first rail;

c. a first roller set for engaging opposite sides of said first rail;

d. a first coupling means for coupling said first roller set to said frame;

e. a first pressing means for pressing said first roller set against said first rail to create sufficient traction contact area between said first roller set and said first rail to support the weight of said frame;

f. a second rail extending along and mounted to the vertical support and parallel to said first rail at a constant vertical gauge;

g. a second roller set for engaging opposite sides of said second rail;

h. a second coupling means for coupling said second roller set to said frame;

i. a second pressing means for pressing said second roller set against said second rail to create sufficient traction contact area between said second roller set and said second rail, and also to support the weight of said frame;

j. a drive means respectively coupled to said first and second roller sets for driving said frame in either direction;

k. each of said pressing means including a spring means that directly engages the respective roller set at a direction perpendicular to the respective rail; and l. said first and second coupling means, each including a mounting plate coupled to said frame at a point coincident with the axes of said first and second roller sets respectively for supporting the weight of said frame.

28. The lift system in accordance with claim 27 wherein each of said pressing means further includes a traction adjustment bolt connected to an internal plate which is slidably located within a pair of interlocking tubes for allowing the internal plate to be adjusted to compress said spring means and providing additional traction pressure.

29. The lift system in accordance with claim 28 further comprising a set screw for providing a positive lock on said traction adjustment bolt once traction has been properly adjusted.

30. The lift system in accordance with claim 27 wherein said first and second pressing means generate sufficient traction between said first and second roller sets and said first and second rails respectively, in response to actuation of said drive means, where said frame moves along said first and second rails in either direction as said first and second roller sets rotate, due to the rotation of said first and second roller sets.

31. The lift system in accordance with claim 27 further comprising a tie bar connecting said each mounting plate to provide positive connection between said each mounting plate and to ensure that said each mounting plate rotates simultaneously when encountering any change in travel angle subsequently providing additional stability when traversing said first and second rails.

32. The lift system in accordance with claim 27 wherein said first and second roller sets comprise an upper fixed roller and a pair of lower pressure rollers.

33. The lift system in accordance with claim 32 further comprising a bracket for respectively receiving each of said pair of pressure rollers, where the bracket is secured on a radial axle to permit rotation in the horizontal plane, thereby providing said pair of pressure rollers with omni-directional movement while allowing the bracket to remain fixed with respect to said upper fixed roller in the vertical plane.

34. The lift system in accordance with claim 33 further comprising a self-aligning bearing located within each of said pair of pressure rollers for permitting the horizontal plane rotation while ensuring that said bracket remain fixed with respect to said fixed roller in the vertical plane.

35. The lift system in accordance with claim 32 wherein said pressure rollers of said first and second roller sets are arranged on dual rotation axes in both horizontal and vertical planes to provide an omni-directional movement of said pressure rollers to maintain traction contact though complex bends in said first and second rails.

36. The lift system in accordance with claim 32 wherein said fixed driven rollers of said first and second roller sets are equipped with a polyurethane traction rib located on the center line of the roller periphery in such a manner as to increase traction while avoiding the tangential contact area to increase wear ability.

37. The lift system in accordance with claim 32 wherein said fixed driven rollers of said first and second roller sets are made of steel.

38. The lift system in accordance with claim 32 wherein said fixed driven rollers of said first and second roller sets are made of composite clad steel.

39. A lift system, comprising:

a. a first rail extending parallel to a stairway step nose angle and mounted to a vertical support;

b. a frame being movable along said first rail;

c. a first roller set for engaging opposite sides of said first rail;

d. a first coupling means for coupling said first roller set to said frame;

e. a first pressing means for pressing said first roller set against said first rail to create sufficient traction contact area between said first roller set and said first rail to support the weight of said frame;

f. a second rail extending along and mounted to the vertical support and parallel to said first rail at a constant vertical gauge;

g. a second roller set for engaging opposite sides of said second rail;

h. a second coupling means for coupling said second roller set to said frame;

i. a second pressing means for pressing said second roller set against said second rail to create sufficient traction contact area between said second roller set and said second rail, and also to support the weight of said frame;

j. a drive means respectively coupled to said first and second roller sets for driving said frame in either direction;

k. each of said pressing means including a spring means that directly engages the respective roller set at a direction perpendicular to the respective rail; and l. said first and second roller sets, each including an upper fixed roller and a pair of lower pressure rollers.

40. The lift system in accordance with claim 39 wherein each of said pressing means further includes a traction adjustment bolt connected to an internal plate which is slidably located within a pair of interlocking tubes for allowing the internal plate to be adjusted to compress said spring means and providing additional traction pressure.

41. The lift system in accordance with claim 40 further comprising a set screw for providing a positive lock on said traction adjustment bolt once traction has been properly adjusted.

42. The lift system in accordance with claim 39 wherein said first and second pressing means generate sufficient traction between said first and second roller sets and said first and second rails respectively, in response to actuation of said drive means, where said frame moves along said first and second rails in either direction as said first and second roller sets rotate, due to the rotation of said first and second roller sets.

43. The lift system in accordance with claim 39 wherein said first and second coupling means, each including a mounting plate coupled to said frame at a point coincident with the axes of said first and second roller sets respectively for supporting the weight of said frame.

44. The lift system in accordance with claim 43 further comprising a tie bar connecting said each mounting plate to provide positive connection between said each mounting plate and to ensure that said each mounting plate rotates simultaneously when encountering any change in travel angle subsequently providing additional stability when traversing said first and second rails.

45. The lift system in accordance with claim 39 further comprising a bracket for respectively receiving each of said pair of pressure rollers, where the bracket is secured on a radial axle to permit rotation in the horizontal plane, thereby providing said pair of pressure rollers with omni-directional movement while allowing the bracket to remain fixed with respect to said upper fixed roller in the vertical plane.

46. The lift system in accordance with claim 39 further comprising a self-aligning bearing located within each of said pair of pressure rollers for permitting the horizontal plane rotation while ensuring that said bracket remain fixed with respect to said fixed roller in the vertical plane.

47. The lift system in accordance with claim 39 wherein said pressure rollers of said first and second roller sets are arranged on dual rotation axes in both horizontal and vertical planes to provide an omni-directional movement of said pressure rollers to maintain traction contact though complex bends in said first and second rails.

48. The lift system in accordance with claim 39 wherein said fixed driven rollers of said first and second roller sets are equipped with a polyurethane traction rib located on the center line of the roller periphery in such a manner as to increase traction while avoiding the tangential contact area to increase wear ability.

49. The lift system in accordance with claim 39 wherein said fixed driven rollers of said first and second roller sets are made of steel.

50. The lift system in accordance with claim 39 wherein said fixed driven rollers of said first and second roller sets are made of composite clad steel.

* * * * *